United States Patent [19]

Sanda et al.

[11] Patent Number: 4,629,139

[45] Date of Patent: Dec. 16, 1986

[54] WEB WINDING APPARATUS

[75] Inventors: Akihiro Sanda; Nobuyuki Watabe; Hiroki Sato, all of Minami-ashigara, Japan

[73] Assignee: Fuji Photo Film Co., Ltd., Japan

[21] Appl. No.: 711,495

[22] Filed: Mar. 14, 1985

[30] Foreign Application Priority Data

Mar. 19, 1984 [JP] Japan ..... 59-53161

[51] Int. Cl.[4] ..... B65H 35/02

[52] U.S. Cl. ..... 242/56.4; 242/56.9; 242/67.1 R

[58] Field of Search ..... 242/56.4, 56.5, 56.6, 242/56.7, 56.2, 56.9, 67.1 R, 68.4, 80

[56] References Cited

U.S. PATENT DOCUMENTS

| | | | |
|---|---|---|---|
| 1,995,026 | 3/1935 | Gast | 242/56.5 X |
| 2,130,332 | 9/1938 | Davis | 242/56.4 X |
| 2,698,359 | 12/1954 | Roberts | 242/56.4 X |
| 3,424,395 | 1/1969 | Schmidt et al. | 242/56.9 X |
| 3,536,273 | 10/1970 | Hawkins | 242/56.7 |
| 4,055,313 | 10/1977 | Yamaguchi et al. | 242/56.4 |
| 4,342,432 | 8/1982 | Lund et al. | 242/56.4 X |
| 4,398,678 | 8/1983 | Kron et al. | 242/56.4 X |

*Primary Examiner*—John M. Jillions
*Attorney, Agent, or Firm*—Parkhurst & Oliff

[57] ABSTRACT

This invention depicts a web winding apparatus for winding belt-like materials (webs) such as plastic films, paper, thin metallic strips, which are slit to a predetermined width by a slitter. This web winding apparatus has at least one winder unit detachably mounted to a main body of winding apparatus. The or each of the winder units includes a support beam detachably mounted to the main body of winding apparatus, a plurality of pairs of arms provided on the support beam, for holding reels to wind slit webs from opposite sides and winding tension generators provided on the support beam corresponding in number to the reels, for giving a winding tension to the reels. A plurality of winder units are prepared in advance having the aforesaid arrangement, having various arm intervals arranged to accommodate to the widths of the slit, whereby winder units corresponding to the widths of webs are mounted to the winding apparatus. Since the arms secured to the winder unit are of stationary type, the winding quality of the product roll is satisfactory and a change in the width of web can be easily accommodated.

7 Claims, 5 Drawing Figures

WEB WINDING APPARATUS

BACKGROUND OF THE INVENTION

1. Field of the Invention

This invention relates to a web winding apparatus, and more particularly to a unit construction of a web winding apparatus for winding belt-like materials such as plastic films, paper, thin metallic strips (hereinafter referred to as webs), being slit to a predetermined width by a slitter.

2. Description of the Prior Art

There has heretofore been proposed a winding apparatus, wherein intervals between arms for holding winding reels can be desirably accommodated to the widths of webs after being slit. For example, in U.S. Pat. No. 4,398,678 which corresponds to PCT-international publication No. WO 82-03845, there has been proposed a winding apparatus, wherein a pair of vertical, parallel, plate-like slitter modules are slidably movable laterally relative to one another for varying the distance therebetween. Each slitter module further has a pair of flanges extending toward one another for supporting a pair of coacting knives. A web is slit by the knives into a plurality of web strips which are guided and wound onto cores. However, the variable width winding apparatus is of such an arrangement that the arm is split into two including the right and left ones, whereby, when the split arms hold a winding reel, shift and slant of a rotary axis of the winding reel tend to occur. Since a moving mechanism is provided at support portions for the arms, the arms are inferior in mounting accuracy to arms which are completely fixed. As a result, with a roll after the slit width of the web is changed over, the winding quality of the web is deteriorated, whereby labor and time are needed for the accommodation, thus possibly resulting in lowered productivity.

SUMMARY OF THE INVENTION

The present invention has been developed to obviate the above-described disadvantages of the prior art and has as its object the provision of a web winding apparatus, wherein accommodation to a change in width of web can be easily made and web rolls having high winding quality can be obtained.

The present invention features that, in a web winding apparatus for winding webs slit to a predetermined width by a slitter, each of the winder units includes a support beam detachably mounted to a main body of winding apparatus, a pair of arms for holding a reel to wind a slit web from opposite sides, a plurality of said pair of arms being provided on the support beam at regular intervals, and a winding tension generator for each of the reels provided on the support beam and detachably connected to a winding driver on the main body of winding apparatus, for giving a winding tension to the reel, and at least one winding unit is detachably provided on the main body of winding apparatus.

BRIEF DESCRIPTION OF THE DRAWINGS

The exact feature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

The invention will now be described by way of example with reference to the accompanying drawings.

Figure 1:
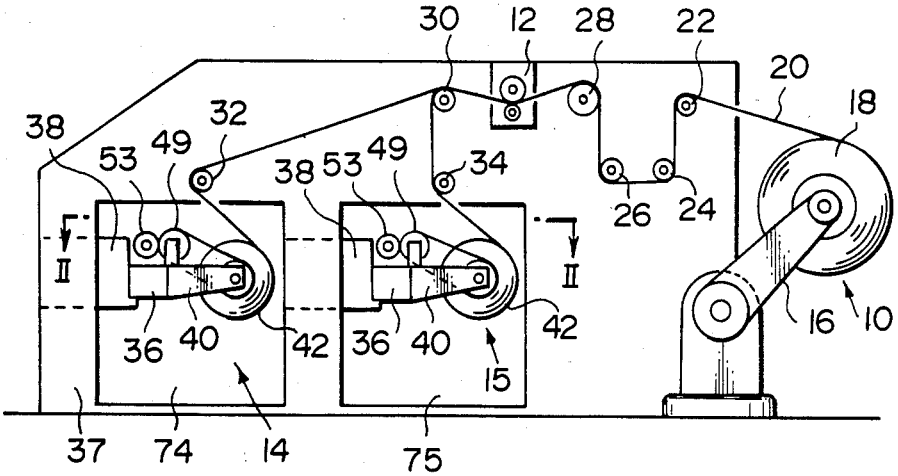
FIG. 1 is an explanatory view showing the schematic construction of an embodiment of the present invention.
Figure 2:
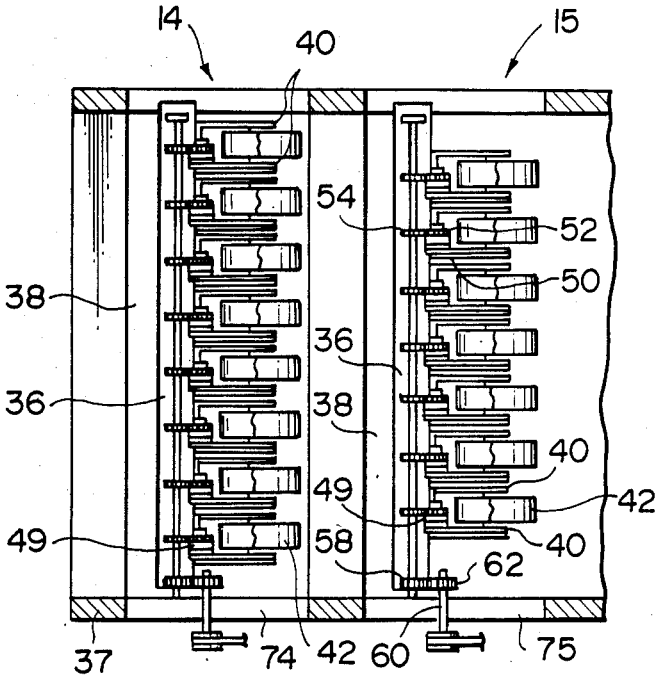
FIG. 2 is a sectional plan view taken along the line II—II in FIG. 1.

FIGS. 1 and 2 show the schematic construction of the winding apparatus according to the present invention. As shown in FIG. 1, the winding apparatus according to the present invention includes an unwinder 10, a slitter unit 12 and winder units 14 and 15. First, the unwinder 10 will be described. Held at the forward end portion of unwinder arms 16 is a master roll 18, from which a web 20 is passed through guide rollers 22, 24, 26 and 28 and fed to a slitter unit 12. The web 20, which is slit to a predetermined width in the slitter unit 12, is distributed into odd rows and even rows and fed to the winder units 14 and 15 which are adjacent to each other. More specifically, at a position of a guide roller 30, the odd rows are fed to the winder unit 14 through a guide roller 32 and the even rows to the winder unit 15 through a guide roller 34.

Figure 3:
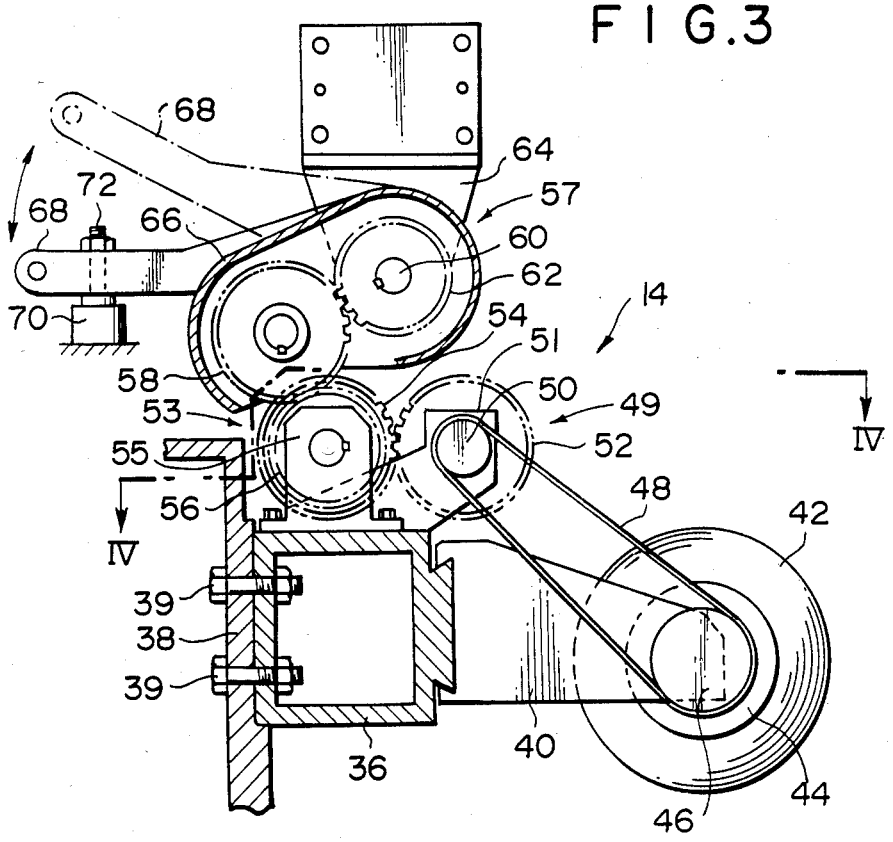
FIG. 3 is a sectional side view showing the essential portions of the embodiment of the present invention.

Description will hereunder be given of the construction of the winder unit 14 with reference to FIG. 3. A support beam 36 which is part of the winder unit 14 is detachably assembled on a mount 38 on the side of a main body 37 of winding apparatus using bolts 39 and 39 for example. As shown in FIG. 2, this support beam 36 is provided thereon with a plurality of winder arms 40,40, positioned at regular intervals along the beam 36. The plurality of winder arms 40, constituting a set, can hold a winding reel 44 of a finished roll 42 from opposite sides. As shown in FIG. 3, a pulley 46 for rotating the reel 44 is provided on the forward ends of the winder arms 40 and connected to a pulley 50 constituting a winding tension generator 49 using a belt 48. A gear 52 is provided coaxially with this pulley 50 and is in mesh with a gear 54 constituting a winding drive transmission 53.

Figure 4:
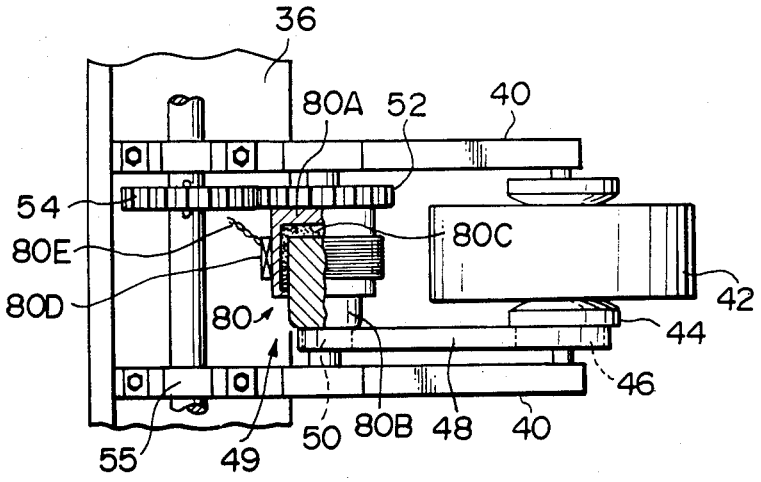
FIG. 4 is a sectional view taken along the line IV—IV in FIG. 3.

As shown in FIG. 4, the winding tension generator 49 is provided thereon with a powder clutch 80. The powder clutch 80 is interposed between the pulley 50 and the gear 52. The powder clutch 80 is constituted by a tubular member 80A disposed on the side of the gear 52, a shaft 80B provided on the side of the pulley 50 and a portion of which is positioned in the tubular member 80A, metallic powder 80C provided between the tubular member 80A and the shaft 80B and an electromagnet 80D. Connected to the electromagnet 80D is a cable 80E. A current supply value fed from this cable 80E to the electromagnet 80D can be varied, so that a web winding tension can be held at a constant value. The current supply value from the cable 80E is variable in accordance with a web winding value by the finished roll 42. For example, the current supply value can be gradually decreased with the increase of the web winding diameter of the finished roll 42, so that the web winding tension can be held at a constant value.

Further, this winding drive transmission 53 is provided with a gear 56 coaxial with a gear 54. This gear 56 is in mesh with a gear 58 of a winding driver 57. The winding tension generator is secured to the support beam 36 through a bracket 51, and the winding drive transmission 53 is secured to the support beam 36 through a bracket 55. The winding driver 57 includes the gear 58 and a gear 62. Gear 62 is on a drive shaft 60 and is in mesh with gear 58. The drive shaft 60 is supported by a bracket 64 on the side of the main body 37 of winding apparatus and connected to a driving source, not shown. The gears 58 and 62 are disposed in a rocking case 66 being of a generally elliptic shape in cross section, and this rocking case 66 can rock about the drive shaft 60. More specifically, if a handle 68 provided on the rocking case 66 is moved and positioned at a position indicated by two-dot chain lines in the drawing, then the gear 58 of the winding driver 57 is separated from the gear 56 of the winding drive transmission 53, whereby the driving force of the drive shaft 60 is not transmitted to the winder unit 14. On the other hand, if the handle 68 is turned from the position indicated by the two dot chain lines in the counterclockwise direction and positioned at a position indicated by solid lines in the drawing, then the gear 58 is brought into mesh with the gear 56, whereby the driving force of the winding drive shaft 60 can be transmitted to the winder unit 14. The handle 68, in its condition of transmitting the driving force, is fixed to a holder 70 using a bolt 72. As described above, the winder unit 14 includes the support beam 36, winder arms 40, winding tension generator 49 and winding drive transmission 53. Since these members constituting the winder unit 14 are supported by the support beam 36, the winder unit 14 can be removed from the main body 37 of winding apparatus by the removal of the support beam 36 from the unit mount 38.

The foregoing is the description of the winder unit 14, and the construction of the winder unit 15 adjacent the winder unit 14 is similar to the winder unit 14.

Figure 5:
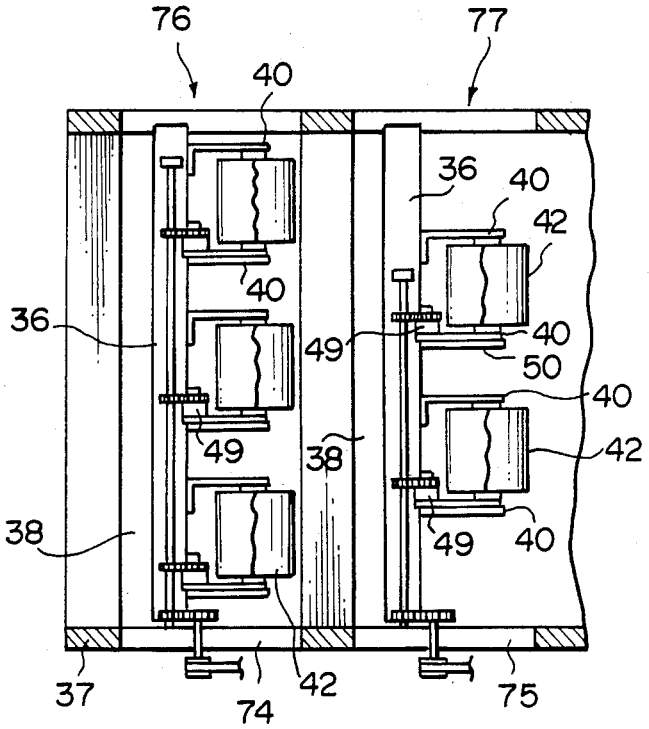
FIG. 5 is a sectional view similar to FIG. 2, showing webs of another width being slit.

The following is the action of the embodiment according to the present invention with the above-described arrangement. Firstly, the web 20 fed from the master roll 18 installed in the unwinder 10 is slit to a predetermined width by the slitter unit 12. Webs 20 slit to a predetermined width are distributed to the odd rows and even rows at the position of the guide roller 30, and fed to the winder units 14 and 15 disposed adjacent to each other. The winder units 14 and 15 are previously disposed, being provided therein with the winder arms corresponding to the slit widths. As described above, when the handle 68 is secured to the holder 70 using the bolt 72, the driving force transmitted from the drive shaft 60 is transmitted to the pulley 50 through the gears 62, 58, 56, 54 and 52. The pulley 50 rotates the pulley 46 of the finished roll 42 through the timing belt 48 to thereby form the finished roll 42. In this case, a powder clutch is used in the winding tension generator 49, whereby a predetermined value of tension is given. In consequence, in forming the finished roll 42, excessively strong winding force does not damage the web 20, nor does excessively weak winding force deflect the web 20. Upon completion of winding, the bolts 39 and 39 are untightened, the support beam 36 is removed from the mount 38, and the winder units 14 and 15 are removed through openings 74 and 75. Subsequently, new winder units are mounted through the openings 74 and 75. In this case, the winder units, provided with arms having intervals corresponding to the widths of the web are mounted to the mount 38. For example, FIG. 5 shows the state where the new winder units different from the winder units 14 and 15 in FIG. 2 are secured. In other words, the winder units 76 and 77 shown in FIG. 5 can wind the slit webs larger in width than the winder units 14 and 15 shown in FIG. 2.

As has been described hereinabove, in the unit construction of the web winding apparatus according to the present invention, the winder units are provided in a manner to be detachable from the main body of winding apparatus, so that the winder units secured thereto with stationary type arms corresponding to the slit widths of the web can be mounted, thus enabling to avoid lowered quality of the finished roll in the winding operation. Furthermore, the winder units each including the winder arms, winding tension generator, and winding drive transmission are mounted or removed so as to be accommodated to a change in widths of the web, so that a change in width of the web can be rapidly accommodated.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A web winding apparatus for winding webs slit to a predetermined width, said web winding apparatus comprising a main body and at least one winder unit, said at least one winder unit comprising:

a winding driver;

a support beam detachably mounted to said main body;

a plurality of pairs of arms and a plurality of reels for winding a slit web, each of said pairs of arms holding one of said plurality of reels from opposite sides thereof, said plurality of said pairs of arms being provided on said support beam at regular intervals; and a plurality of winding tension generators provided on said support beam and detachably connected to said winding driver, said at least one winding driver thereby giving a winding tension to said reels.

2. The web winding apparatus set forth in claim 1, further comprising a master roll, a slitter, a plurality of said winder units, whereby webs are unwound from said master roll, slit by said slitter to create at least two separate slit webs, and said at least two separate webs are wound on said reels of different ones of said plurality of winder units.

3. The web winding apparatus as set forth in claim 2, wherein each said winding tension generator is detachably connected to said winding driver through a winding drive transmission.

4. A web winding apparatus as set forth in claim 3, wherein:

said winding reel is connected to said winding tension generator through a belt;

said winding tension generator is connected to said winding drive transmission through gears; and said winding drive transmission is detachably connected to said winding driver through gears.

5. A web winding apparatus as set forth in claim 4, wherein:

said winding tension generator includes a powder clutch; and a predetermined value of tension is given to said winding reel.

6. A web winding apparatus as set forth in claim 5, wherein said winding driver includes a rocking case incorporating therein a group of transmission gears, whereby said winding driver can be disconnected by rocking of said rocking case.

7. The web winding apparatus as set forth in claim 6, wherein a plurality of winder units are previously prepared having different intervals between arms to accommodate different web widths.

* * * * *